US005828765A

United States Patent [19]

Gable

[11] Patent Number: 5,828,765

[45] Date of Patent: Oct. 27, 1998

[54] AUDIO LOUDSPEAKER ASSEMBLY FOR RECESSED LIGHTING FIXTURE AND AUDIO SYSTEM USING SAME

[76] Inventor: Tony L. Gable, OEM Systems Company, Inc., 740 Freeport, Ste. 106, Sparks, Nev. 89431

[21] Appl. No.: 643,167

[22] Filed: May 3, 1996

[51] Int. Cl.[6] ..... H04R 25/00

[52] U.S. Cl. ..... 381/188; 381/152; 381/205; 181/150

[58] Field of Search ..... 381/152, 182, 381/186, 189, 188, 205, 87, 88, 90; 181/150, 199

[56] References Cited

U.S. PATENT DOCUMENTS

| | | | |
|---|---|---|---|
| 2,924,661 | 2/1960 | Messeas, Jr. | 179/1 |
| 3,796,839 | 3/1974 | Torn | 381/182 |
| 3,884,326 | 5/1975 | Orisek | 181/150 |
| 3,911,221 | 10/1975 | Wong | 179/1 R |
| 3,932,711 | 1/1976 | O'Brien et al. | 381/152 |
| 4,061,971 | 12/1977 | Barrons | 455/90 |
| 4,434,509 | 2/1984 | Schredel | 455/343 |
| 4,507,800 | 3/1985 | Kelly | 381/88 |
| 4,528,620 | 7/1985 | Weber | 362/86 |
| 4,692,942 | 9/1987 | Morgand | 381/114 |
| 4,776,018 | 10/1988 | Cordier | 381/88 |
| 4,963,854 | 10/1990 | Stuecker | 340/384 |
| 5,335,284 | 8/1994 | Lemons | 381/152 |
| 5,444,194 | 8/1995 | Reinke | 181/150 |

OTHER PUBLICATIONS

Catalog 33 of MCM Electronics, May 1994.

*Primary Examiner*—Huyen Le

*Attorney, Agent, or Firm*—Flanagan & Flanagan; John R. Flanagan; John K. Flanagan

[57] ABSTRACT

An audio loudspeaker assembly for use with a recessed lighting fixture includes a housing, a male socket attached to and projecting from the housing and being adapted for insertion into a female socket within the recessed lighting fixture, a pair of electrical contacts mounted to the male socket for making an electrical connection with a pair of like electrical contacts mounted to the female socket, an audio loudspeaker module having electrical terminals and being disposed in the housing, and a pair of internal electrical conductor wires disposed in the housing and being connected to the pair of electrical contacts of the male socket and extending therefrom and being connected to the electrical terminals of the audio loudspeaker module. A pair of external electrical conductor wires also extend from the female socket of the recessed lighting fixture to an audio receiver of an audio system so as to electrically connect the audio loudspeaker assembly via the recessed lighting fixture to the audio receiver for activation and operation by the audio receiver.

12 Claims, 1 Drawing Sheet

AUDIO LOUDSPEAKER ASSEMBLY FOR RECESSED LIGHTING FIXTURE AND AUDIO SYSTEM USING SAME

BACKGROUND OF THE INVENTION

1. Field of the Invention

The present invention generally relates to speaker assemblies and, more particularly, is concerned with an audio loudspeaker assembly for use with a recessed lighting fixture and an audio system using the assembly and fixture.

2. Description of the Prior Art

Loudspeakers for audio stereo systems often take up considerable space, are cumbersome, unattractive and are susceptible to damage. While the receiver of the system must be accessible to a user for controlling the system, it is often desirable to place loudspeakers away from the vicinity of the receiver powering and sending signals to them so as to hide the loudspeakers and/or to place them in locations where the loudspeakers are not likely to be damaged. Placement of the loudspeakers in locations away from one another may further improve the overall sound of the system as heard by the user.

A variety of assemblies have been developed over the years for retaining loudspeakers in locations away from one another and away from a central receiver of an audio stereo system. A variety of assemblies have also been developed which mount light-bulbs and loudspeakers or the like in the same fixture. Representative examples of these prior art assemblies and other like devices are disclosed in U.S. Pat. Nos. 2,924,661 to Messeas, Jr., 3,911,221 to Wong, 4,061,971 to Barrons, 4,434,509 to Schrepel, 4,475,226 to Greenberg, 4,507,800 to Kelly, 4,528,620 to Weber, 4,692,942 to Morgand, 4,776,018 to Cordier, 4,963,854 to Stuecker and 5,335,284 to Lemons.

One of these prior art assemblies, as disclosed in the Cordier patent, has proposed to use a light-bulb socket to mount and to provide electrical power directly to a radio set. The Cordier patent, however, is limited in its use to radio sets and to other like devices which utilize the same electrical power as the light bulb which they replace and so does not appear to teach a specific solution for mounting loudspeakers alone which would not utilize the same electrical power.

Consequently, a need still exists for a device or assembly which overcomes the aforementioned problem in the prior art without introducing any new problems in place thereof.

SUMMARY OF THE INVENTION

The present invention provides an audio loudspeaker assembly for use with a recessed lighting fixture designed to satisfy the aforementioned need. The assembly of the present invention is especially adapted for use with pre-existing conventional recessed lighting fixtures and does not require significant alterations of these fixtures for the intended function thereof. The audio loudspeakers of the assembly do not take up space outside of the recessed lighting fixtures and are not as cumbersome, unattractive or as susceptible to damage as those audio loudspeakers which are not so installed.

Accordingly, the present invention is directed to an audio loudspeaker assembly for use with a recessed lighting fixture. The audio loudspeaker assembly comprises: (a) a housing; (b) a male socket means projecting from the housing and being adapted for insertion into a female socket means within the recessed lighting fixture; (c) a pair of electrical contacts mounted to the male socket means for making an electrical connection with a pair of electrical contacts mounted to the female socket means; (d) an audio loudspeaker module having electrical terminals and being disposed in the housing; and (e) a pair of internal electrical conductor wires disposed in the housing and being electrically connected to the pair of electrical contacts of the male socket means and extending therefrom and being electrically connected directly to the electrical terminals of the audio loudspeaker module.

More particularly, the housing is substantially cylindrical in shape and is defined by a rear end wall, a continuous sidewall connected to and extending from the rear end wall and an open front end on the sidewall opposite from the rear end wall. The male socket means has an externally threaded surface adapted to threadably screw into an internaly threaded surface of the female socket means of the recessed lighting fixture. The male socket means has the pair of electrical contacts mounted thereto in an electrically insulated relationship with respect to one another. Each of the contacts has respective outer portions exposed at the exterior of the male socket means for making an electrical connection with the pair of like electrical contacts mounted to the female socket means. The contacts also have respective inner portions exposed to the interior of the housing.

Furthermore, the audio loudspeaker module includes a front end with an annular flange detachably attached to the open front end of the housing sidewall, a rear permanent magnet at a rear end, a front tweeter and a conical woofer supporting the rear magnet and the front tweeter in axially spaced relation to one another. A front edge of the conical woofer defines the annular flange of the module which is attachable to the open front end of the housing. The pair of internal electrical conductor wires, as mentioned above, extend between the electrical contacts of the male socket means and the electrical terminals of the audio loudspeaker module on the front tweeter for electrical connection thereof.

The present invention is also directed to an audio system which comprises: (a) an audio receiver; (b) a recessed lighting fixture with the female socket means and a pair of electrical contacts mounted to the female socket means; (c) a pair of external electrical conductor means extending between and electrically interconnecting the audio receiver and the pair of electrical contacts of the female socket means of the recessed lighting fixture; and (d) an audio loudspeaker assembly as defined above which is separate from the audio receiver and capable of activation and operation by said audio receiver, the audio loudspeaker assembly being removably mounted to the recessed lighting fixture such that external electrical conductor means via the recessed lighting fixture electrically connects the audio loudspeaker assembly to the audio receiver for activation and operation by the audio receiver.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
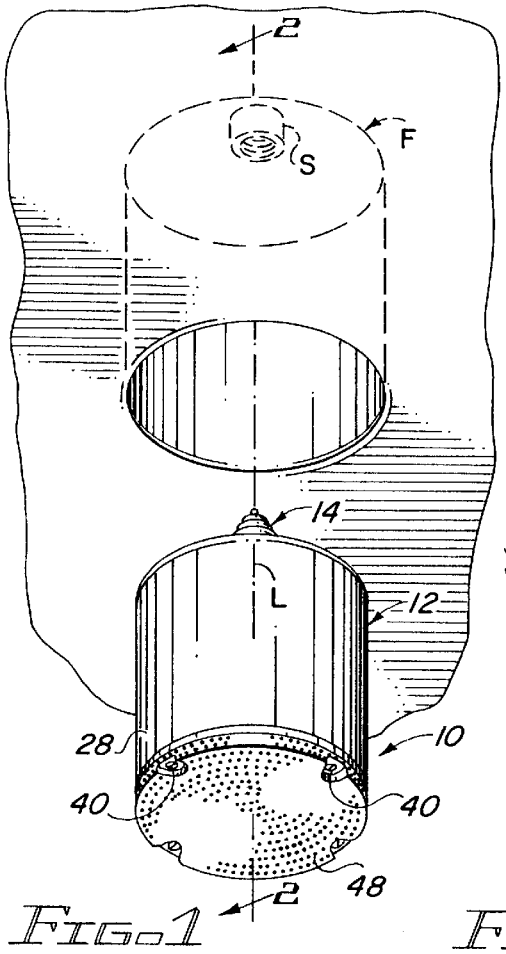
FIG. 1 is a bottom perspective view of an audio loudspeaker assembly of the present invention axially aligned with a recessed lighting fixture mounted in a ceiling.
Figure 3:
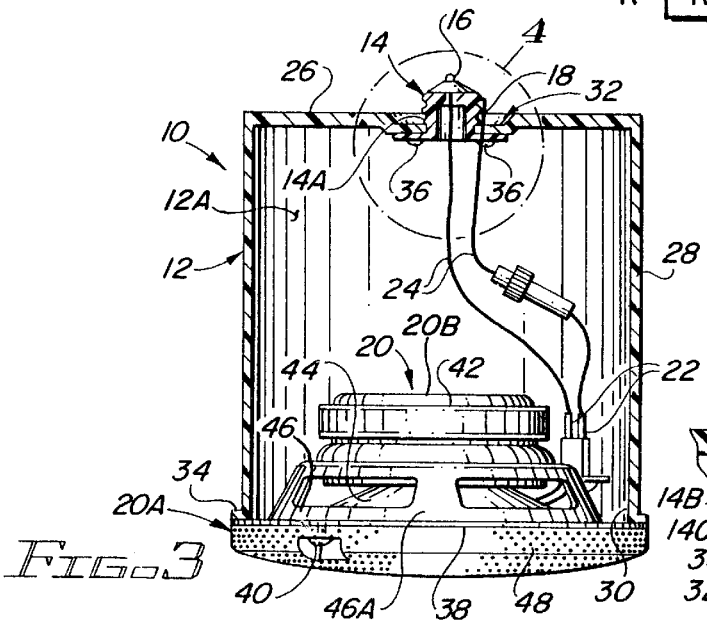
FIG. 3 is an enlarged side elevational view of the assembly partially in cross-section and showing the interior thereof.

Referring to the drawings and particularly to FIGS. 1 and 3, there is illustrated an audio loudspeaker assembly, generally designated 10, of the present invention. The audio loudspeaker assembly 10 is intended for installation in a substantially pre-existing conventional recessed lighting fixture F having a female socket means S which is adapted to have a conventional light bulb threadably screwed therein. However, a pair of external electrical conductor wires C electrically connected to and extending from the female socket means S contained within the fixture F are no longer connected directly to the source of a.c. power supplied on utility power lines to a building in which the fixture is installed. Instead, as seen in FIG. 5, the conductor wires C are connected to an audio receiver R of a conventional audio system A for transmitting signals to the fixture F which are capable of activating and operating the audio loudspeaker assembly 10 to produce sound when the assembly 10 is installed in the fixture F in the absence of the light bulb being threadably screwed therein.

Basically, the audio loudspeaker assembly 10 includes a housing 12, a male socket means 14 attached to and projecting from the housing 12 and being adapted for insertion into the female socket means S within the recessed lighting fixture F, and a pair of electrical contacts 16, 18 mounted to the male socket means 14 for making an electrical connection with a pair of electrical contacts X, Y mounted to the female socket means S. The audio loudspeaker assembly. 10 further includes an audio loudspeaker module 20 having a pair of electrical terminals 22 and being disposed in the housing 12, and a pair of internal electrical conductor wires 24 disposed in the housing 12 and electrically connected to the pair of electrical contacts 16, 18 of the male socket means 14 and extending therefrom and being electrically connected to the electrical terminals 22 of the audio loudspeaker module 20.

Referring now to FIGS. 1 to 4, the housing 12 more particularly is substantially cylindrical in shape and has an interior cavity 12A defined by a rear end wall 26, a continuous sidewall 28 connected to and extending from the rear end wall 26 and an open front end 30 on the sidewall 28 opposite from the rear end wall 26. The rear end wall 26 and the sidewall 28 each have the same diameter and are made of the same rigid material, being fabricated by any suitable conventional technique, such as by injection molding. As clearly depicted in FIG. 2, the housing 12 is smaller in diameter and axial length than the fixture F permitting insertion of the housing 12 within the fixture F. The rear end wall 26 also has an external circular depression 32 defined therein. The depression 32 particularly has a sloping outer portion 32A and a flat inner portion 32B with each portion 32A, 32B being concentric relative to the other and having a central opening 32C for attachment of the male socket means 14 therethrough. An annular ledge 34 also extends about and radially outwardly from the open front end 30 of the housing 12. The annular ledge 34 has a plurality of holes 34A defined therethrough for receiving suitable fasteners for attachment of the audio loudspeaker module 20 thereto.

Figure 2:
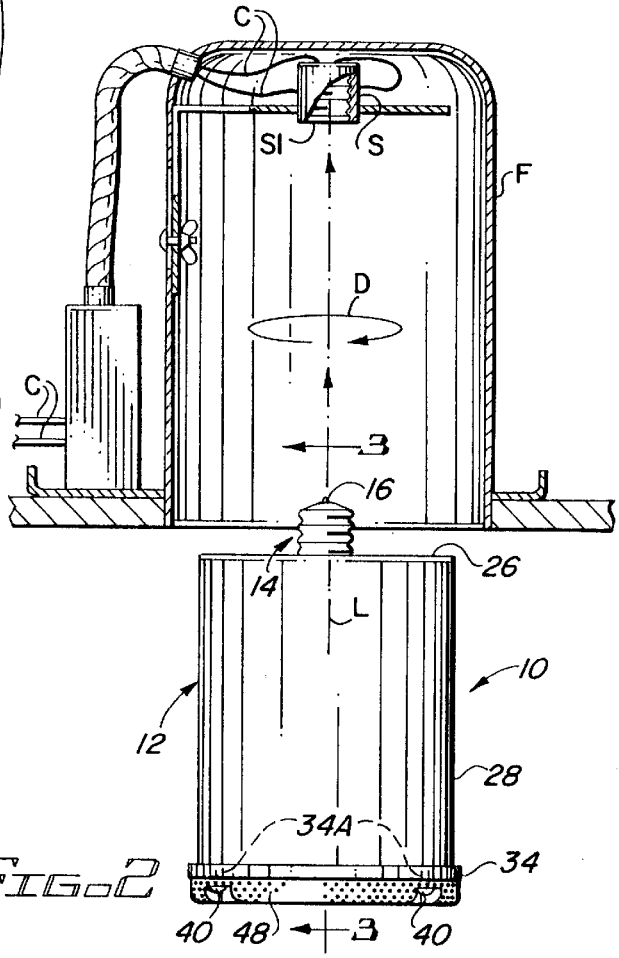
FIG. 2 is an enlarged side elevational view of the audio loudspeaker assembly and the recessed lighting fixture being shown in longitudinal sectional form.
Figure 5:
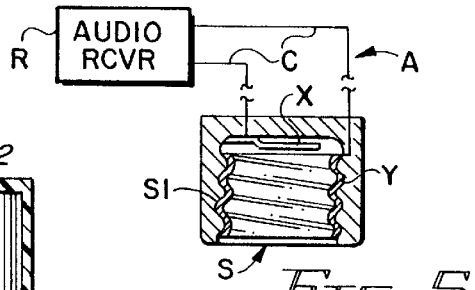
FIG. 5 is an enlarged detailed sectional view of a female socket means of the recessed lighting fixture shown electrically connected to an audio receiver of an audio system.
Figure 4:
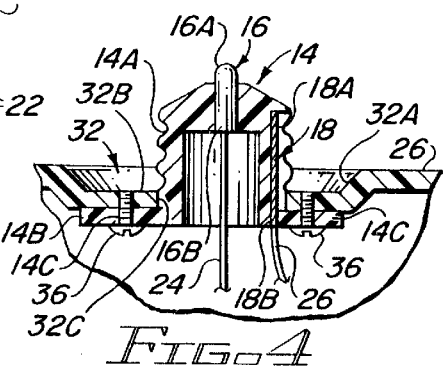
FIG. 4 is an enlarged detailed sectional view of the area enclosed by circle 4 of FIG. 3.

The male socket means 14 more particularly has an externally threaded surface 14A, as shown particularly in FIG. 4, adapted to threadably screw into a complementarily internally threaded surface S1 of the female socket means S of the recessed lighting fixture F, as shown particularly in FIG. 5. The male socket means 14 further has an integrally molded base portion 14B which is substantially rectangular in shape and has a width which is substantially greater than the diameter of the central opening 32C of the rear end wall 32 of the housing 12. The base portion 14B has a pair of opposite holes 14C defined at opposite ends thereof for passage of a pair of fastening screws 36 for attachment of the base portion 14B to the internal side of the inner portion 32B of the rear end wall 32 of the housing 12. The attachment of the base portion 14B to the rear end wall 32 on the internal side thereof thereby retains the male socket means 14 in place on the external side thereof for threadably screwing into the female socket means S of the recessed lighting fixture F by rotating the housing 12 and thus the male socket means 14 therewith about a longitudinal central axis L of the housing 12 extending axially through the male socket means 14, as shown in FIGS. 1 and 2, in the direction of arrow D shown in FIG. 2. Reverse rotation of the housing 12 in the opposite direction will threadably unscrew the male socket means 14 from the female socket means S of the recessed lighting fixture F. Alternatively, the male socket means 14 may be integrally molded to the rear end wall 32 of the housing 12.

Furthermore, the male socket means 14 has the pair of electrical contacts 16, 18 mounted thereto in an electrically insulated relationship with respect to one another. Each of the contacts 16, 18 has respective outer portions 16A, 18A exposed at the exterior of the male socket means 14 for making an electrical connection with inner portions X1, Y1 of the pair of electrical contacts X, Y mounted to the female socket means S. The contacts 16, 18 also have respective inner portions 16B, 18B exposed to the interior cavity 12A of the housing 12. As shown in FIG. 4, the contact 16 is mounted at the outer tip of the male socket means 14 while the contact 18 is mounted along the side of the male socket means 14.

The audio loudspeaker module 20 more particularly includes a front end 20A with an annular flange 38 attached to and surrounding the front end 20A and detachably attached by fastening elements 40 to the holes 34A of the annular ledge 34 at the open front end 30 of the housing sidewall 28. The module 20 also includes a rear permanent magnet 42 at a rear end 20B thereof, a front tweeter 44 and a conical woofer 46 connected to and supporting the rear magnet 42 and the front tweeter 44 in axially spaced relation to one another. A front edge of the conical woofer 46 defines the annular flange 38 of the module 20 which is attachable to the annular ledge 34 at the open front end 30 of the housing 12. The conical woofer 46 also has a diameter at a rear end greater than that of the rear magnet 42 and a diameter at the front edge 46A greater than that of the front tweeter 44. The diameter of the annular flange 38 of the conical woofer 46 is also slightly greater than that of the open front end 30 of the housing 12 so that the annular flange 38 overlies the annular ledge 34 extending outwardly from the open front end 30 of the housing 12 for attachment of the annular flange 38 to the annular ledge 34. Upon attachment, the annular flange 38 and the annular ledge 34 are in flush contact with one another. A dome-shaped perforated protective grill 48 also is preferably installed over the front end of the conical woofer 46 of the module 20 and be attachable therewith to the annular ledge 34 of the housing 12.

The electrical terminals 22 of the audio loudspeaker module 20 are particularly mounted to the front tweeter 44 of the loudspeaker module 20 in side by side relation to one another. The pair of internal electrical conductor wires 24, as mentioned above, extend between and electrically interconnect the electrical contacts 16, 18 attached on the male socket means 14 and the electrical terminals 22 of the module 20. Thus, the internal electrical conductor wires 24 make direct electrical connection with the front tweeter 44 of the loudspeaker module 20. Also, preferably a ground conductor (not shown) would be mounted to the interior surface of the recessed lighting fixture F and extend therefrom to an external location.

Because of the electrical connections provided by the internal electrical conductor wires 24 and external electrical conductor wires C, the audio loudspeaker module 20 of the assembly 10 via the recessed lighting fixture F is electrically connected to the audio receiver R for activation and operation of the loudspeaker module 20 through the control of operation of the audio receiver R from a remote location.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. An audio loudspeaker assembly for a recessed lighting fixture having a female socket means with an internally threaded surface being adapted to have a light bulb threadably screwed therein, the female socket means having a pair of electrical contacts mounted thereon, said assembly comprising:

(a) a housing having a rear end wall and an annular sidewall connected to and extending from said rear end wall and defining an interior cavity of said housing, said annular sidewall of said housing having a front end disposed opposite from said rear end wall;

(b) a male socket means attached to and projecting outwardly from said housing and having an externally threaded surface exposed exteriorly of said housing being adapted to threadably screw into the internally threaded surface of the female socket means within the recessed lighting fixture, in the absence of the light bulb being threadably screwed therein, by rotation of said housing and male socket means therewith relative to the female socket means;

(c) a pair of electrical contacts mounted to said male socket means and being exposed exteriorly of said housing for making an electrical connection with the pair of electrical contacts of the female socket means, said pair of electrical contacts of said male socket means also being exposed in said interior cavity of said housing;

(d) an audio loudspeaker module mounted in said interior cavity of said housing and having electrical terminals disposed in said interior cavity of said housing; and (e) a pair of internal electrical conductor wires disposed in said interior cavity of said housing and being electrically connected to said pair of electrical contacts of said male socket means and extending therefrom and being electrically connected directly to said electrical terminals of said audio loudspeaker module.

2. The assembly of claim 1 further comprising:

a dome-shaped perforated protective grill installed over said audio speaker module and being attachable therewith to said front end of said housing.

3. The assembly of claim 1 wherein said audio loudspeaker module includes a front end with an annular flange detachably attached by fastening elements to said front end of said housing, a rear permanent magnet, a front tweeter and a conical woofer supporting said rear magnet and said front tweeter in axially spaced relation to one another, a front edge of said conical woofer defining said annular flange of said audio loudspeaker module.

4. The assembly of claim 3 wherein said electrical terminals of said audio loudspeaker module are mounted to said front tweeter of said audio loudspeaker module such that said internal electrical conductor wires are electrically connected directly to said front tweeter of said audio loudspeaker module.

5. An audio loudspeaker installation assembly, comprising:

(a) a recessed lighting fixture having a female socket means disposed within said fixture and being adapted to have a light bulb threadably screwed therein, said female socket means having a pair of electrical contacts mounted on said female socket means;

(b) a housing smaller in size than said recessed lighting fixture and disposed within said fixture, said housing having a rear end wall and an annular sidewall connected to and extending from said rear end wall and defining an interior cavity of said housing, said annular sidewall of said housing having an open front end disposed opposite from said rear end wall;

(c) a male socket means attached to and projecting outwardly from said rear end wall of said housing and having an externally threaded surface exposed exteriorly of said housing being adapted to threadably screw into the internally threaded surface of the female socket means of the recessed lighting fixture, in the absence of the light bulb being threadably screwed therein, by rotation of said housing and male socket means relative to said female socket means;

(d) a pair of electrical contacts mounted to said male socket means in an electrically insulated relationship with respect to one another, each of said electrical contacts of said male socket means having respective outer portions exposed at the exterior of said male socket means exteriorly of said housing for making an electrical connection with the pair of electrical contacts of the female socket means, said electrical contacts of said male socket means also having respective inner portions exposed to said interior cavity of said housing;

(e) an audio loudspeaker module having electrical terminals and being disposed in said interior cavity of said housing; and (f) a pair of internal electrical conductor wires disposed in said interior cavity of said housing and being electrically connected to said inner portions of said electrical contacts of said male socket means and extending therefrom and being electrically connected directly to said electrical terminals of said audio loudspeaker module.

6. The assembly of claim 5 wherein said audio loudspeaker module includes a front end with an annular flange detachably attached by fastening elements to said open front end of said housing sidewall, a rear permanent magnet, a front tweeter and a conical woofer supporting said rear magnet and said front tweeter in axially spaced relation to one another, a front edge of said conical woofer defining said annular flange of said audio loudspeaker module which is attachable to said front end of said housing.

7. The assembly of claim 6 wherein said electrical terminals of said audio loudspeaker module are mounted to said front tweeter of said audio loudspeaker module such that said internal electrical conductor wires are electrically connected directly to said front tweeter of said audio loudspeaker module.

8. The assembly of claim 6 further comprising:

a dome-shaped perforated protective grill installed over said front end of said audio loudspeaker module and being attachable therewith to said open front end of said housing.

9. An audio system, comprising:

(a) an audio receiver;

(b) a recessed lighting fixture having a female socket means disposed within said fixture and being adapted to have a light bulb threadably screwed therein, said female socket means having a pair of electrical contacts mounted to said female socket means;

(c) a pair of external electrical conductor means extending between and electrically interconnecting said audio receiver and said pair of electrical contacts of said female socket means of said recessed lighting fixture; and (d) an audio loudspeaker assembly separate from said audio receiver and being capable of activation and operation by said audio receiver, said audio loudspeaker assembly including (i) a housing smaller in size than said recessed lighting fixture and disposed within said fixture, said housing having a rear end wall and an annular sidewall connected to and extending from said rear end wall and defining an interior cavity of said housing, said annular sidewall of said housing having an open front end disposed opposite from said rear end wall, (ii) a male socket means attached to and projecting outwardly from said rear end wall of said housing and having an externally threaded surface exposed exteriorly of said housing being adapted to threadably screw into said internally threaded surface of said female socket means within said recessed lighting fixture, in the absence of the light bulb being threadably screwed therein, by rotation of said housing and male socket means therewith relative to said female socket means, (iii) a pair of electrical contacts mounted to said male socket means in an electrically insulated relationship with respect to one another, each of said electrical contacts of said male socket means having respective outer portions exposed at the exterior of said male socket means exteriorly of said housing for making an electrical connection with said pair of electrical contacts of said female socket means, said electrical contacts of said male socket means also having respective inner portions exposed to said interior cavity of said housing, (iv) an audio loudspeaker module having electrical terminals and being disposed in said interior cavity of said housing, and (v) a pair of internal electrical conductor wires disposed in said interior cavity of said housing and being electrically connected to said inner portions of said electrical contacts of said male socket means and extending therefrom and being electrically connected directly to said electrical terminals of said audio loudspeaker module such that said pair of external electrical conductor means electrically connects said audio loudspeaker assembly via said recessed lighting fixture to said audio receiver for activation and operation by said audio receiver.

10. The audio system of claim 9 wherein said audio loudspeaker module includes a front end with an annular flange detachably attached by fastening elements to said open front end of said housing sidewall, a rear permanent magnet, a front tweeter and a conical woofer supporting said rear magnet and said front tweeter in axially spaced relation to one another, a front edge of said conical woofer defining said annular flange of said audio loudspeaker module which is attachable to said front end of said housing.

11. The audio system of claim 10 wherein said electrical terminals of said audio loudspeaker module are mounted to said front tweeter of said audio loudspeaker module such that said internal electrical conductor wires are connected directly to said front tweeter of said audio loudspeaker module.

12. The audio system of claim 10 wherein said audio loudspeaker assembly further includes a dome-shaped perforated protective grill installed over said front end of said audio loudspeaker module and being attachable therewith to said open front end of said housing.

* * * * *